US006461480B1

(12) United States Patent
Otakura et al.

(10) Patent No.: US 6,461,480 B1
(45) Date of Patent: Oct. 8, 2002

(54) METHOD OF MANUFACTURING PULP MOLD FORMED PRODUCT

(75) Inventors: Shinji Otakura; Yoshiaki Kumamoto; Kenichi Otani; Tadaharu Ogawa; Atsushi Sato, all of Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/622,040

(22) PCT Filed: Feb. 22, 1999

(86) PCT No.: PCT/JP99/00774

§ 371 (c)(1),
(2), (4) Date: Aug. 23, 2000

(87) PCT Pub. No.: WO99/42660

PCT Pub. Date: Aug. 26, 1999

(30) Foreign Application Priority Data

Feb. 23, 1998 (JP) ..... 10-040698
Dec. 18, 1998 (JP) ..... 10-361395

(51) Int. Cl.[7] ..... D21J 7/00

(52) U.S. Cl. ..... 162/220; 162/224; 162/228; 162/230; 162/387; 162/402; 264/87

(58) Field of Search ..... 162/218, 220–224, 162/228–230, 387, 388, 389, 396, 397, 401–406, 416; 264/40.3, 40.5, 86, 87, 299, 301, 306, 313, 315, 319

(56) References Cited

U.S. PATENT DOCUMENTS 1,324,935 A * 12/1919 Sims ..... 162/220
2,961,043 A 11/1960 Hicks et al. ..... 162/401
2,980,183 A * 4/1961 Wells ..... 162/416
3,250,668 A * 5/1966 Modersohn ..... 162/220
4,132,591 A * 1/1979 Merges, Jr. ..... 162/146
4,900,487 A * 2/1990 Lalloz et al. ..... 264/45.2
5,074,339 A * 12/1991 Vohringer ..... 139/383 A
5,900,119 A * 5/1999 Goers et al. ..... 162/218

FOREIGN PATENT DOCUMENTS

| | | | |
|---|---|---|---|
| EP | 0 745 727 | 12/1996 | D21J/5/00 |
| JP | 40-003396 | 2/1965 | |
| JP | 53-147802 | 12/1978 | D21J/3/00 |
| JP | 5-071900 | 5/1980 | D21J/7/00 |
| JP | 7-042100 | 2/1995 | D21J/7/00 |
| JP | 7-223230 | 8/1995 | B29C/43/10 |
| JP | 9-119099 | 5/1997 | D21J/1/06 |

OTHER PUBLICATIONS

T. Goto, Public Relations Department, Kao Corporation, 4 pages, "Paper–Bottle Molding System", Oct. 25, 2000 (with English Translation).
U.S. patent application Ser. No. 09/503,063, Nonomura et al., filed Feb. 14,2000.
U.S. patent application Ser. No. 09/522,039, Kumamoto et al., filed Aug. 23, 2000.

(List continued on next page.)

*Primary Examiner*—Peter Chin
*Assistant Examiner*—Eric Hug
(74) *Attorney, Agent, or Firm*—Oblon, Spivak, McClelland, Maier & Neustadt, P.C.

(57) ABSTRACT

A pulp molded article is produced by depositing pulp fiber on the outer surface of a papermaking core mold having a plurality of interconnecting paths connecting the outside and the inside to form a pulp deposited body, placing the pulp deposited body in a set of split molds, and then pressing the pulp deposited body for dehydration by a prescribed means.

3 Claims, 7 Drawing Sheets

OTHER PUBLICATIONS

U.S. patent application Ser. No. 09/673,687, Kumamoto et al., filed Jan. 6, 2000.
U.S. patent application Ser. No. 09/713,230, Nonomura et al., filed Nov. 18, 2000.
U.S. patent application Ser. No. 09/868,040, Otani et al., filed Jul. 23, 2001.
U.S. patent application Ser. No. 09/889,558, Nonomura, filed Aug. 6, 2001.
U.S. patent application Ser. No.09/928,211, Sato et al., filed Jan. 2, 2002.
U.S. patent application Ser. No. 09/928,990, Otani et al., filed Dec. 3, 2001.
U.S. patent application Ser. No. 10/048,446, Otani et al., filed Feb. 4, 2002.
U.S. patent application Ser. No. 10/110,718, Tojo et al., filed Apr. 15, 2002

* cited by examiner 7
3
6
8a
8
9
10
11
9a
9b
9c 90
20
8
6

2
57
59
4
5
6
8
9
9a
9b
9f

METHOD OF MANUFACTURING PULP MOLD FORMED PRODUCT

BACKGROUND OF THE INVENTION

1. Field of the Invention

This invention relates to a method for producing pulp molded articles useful as, for example, packaging members such as containers and cushioning materials, etc.

2. Discussion of the Background

Plastics are used as general materials of packaging containers, for example, those with a lid and bottles, for their excellent molding properties and productivity. However, because plastic containers involve various problems associated with waste disposal, pulp molded containers formed by pulp molding have been attracting attention as substitutes for plastic containers. Pulp molded containers are not only easy to dispose of but economical because they can be manufactured by using regenerated paper.

Pulp molded articles having the above-described characteristics are produced by, for example as disclosed in Japanese Patent Laid-Open Publication No. 7-42100, depositing pulp fiber on the surface of a papermaking mold in a wet process, drying the resulting wet preform of deposited pulp fiber, and dehydrating and drying the preform by hot pressing from the upper and lower sides by use of a pair of porous molds, male and female, mating with each other.

However, where a preform is pressed from the upper and lower sides by a pair of porous male and female molds as in the above-described method, pressing onto the side wall of containers is uneven, resulting in poor surface properties unless the height of the containers is 60 mm or less and the draft angle, i.e., the angle formed between the draw line and the side wall of containers is 5° or more. Therefore, it is difficult to control the wall thickness (basis weight and density). If a container has a relief design, etc. on it, the container will not be removed from the mold after pressing.

Thus, the above method is disadvantageous in that the possible shapes of molded articles are restricted, it is impossible to execute various designs on the surface of containers, and the surface properties are poor.

Japanese Patent Laid-Open Publication No. 7-223230 discloses a molding method which comprises pressing a molding material between an inner mold and an outer mold, wherein the inner mold is covered with a flexible film capable of expanding to form an contour that is substantially the same as the interior shape of an objective molded article and, at the same time, feeding a fluid from a fluid feed pipe to between the flexible film and the inner mold to inflate the flexible film. In this method, however, because a fluid is fed from one position between the flexible film and the inner mold, the pressing by the inflated flexible film onto the molding material is uneven, resulting in a failure to obtain molded articles uniform in wall thickness.

SUMMARY OF THE INVENTION

Accordingly, an object of the present invention is to provide a method for producing a pulp molded article by which a container having a complicated shape can be obtained regardless of a draft angle, etc. and which enables execution of various designs to provide a beautiful outer appearance with excellent surface smoothness; and to provide pulp molded articles.

The present invention has achieved the above object by providing a method for producing a pulp molded article comprising the steps of depositing pulp fiber on the outer surface of a papermaking core mold having a plurality of interconnecting paths connecting the outside and the inside to form a pulp deposited body, placing the pulp deposited body in a set of split molds, and then pressing the pulp deposited body for dehydration by a prescribed means.

DESCRIPTION OF THE PREFERRED EMBODIMENTS

Specific embodiments of the present invention will be described in detail with reference to the accompanying drawings.

Figure 1:
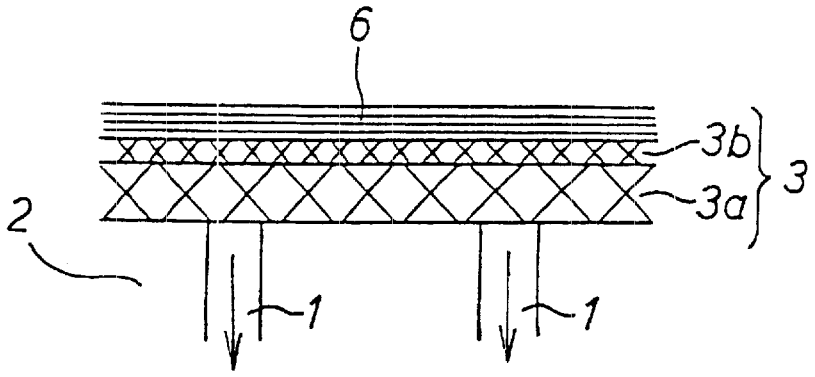
FIG. 1 is an enlarged cross-sectional view showing the main part of a net on which pulp fiber is deposited.
Figure 2:
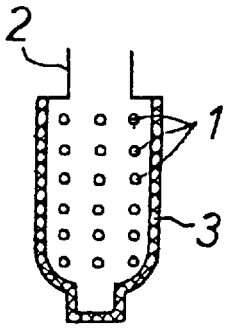
FIG. 2 is a flow chart showing the successive steps up to removal of a pulp deposited body from a mold, wherein FIG. 2(*a*) is the step of attaching a net, FIG. 2(*b*) is the step of papermaking, and FIG. 2(*c*) is the step of removing a pulp deposited body from a mold.
Figure 2:
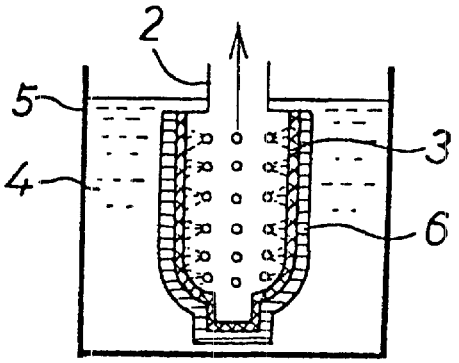
Figure 2:
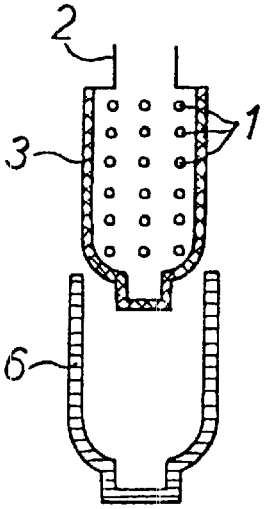
Figure 3:
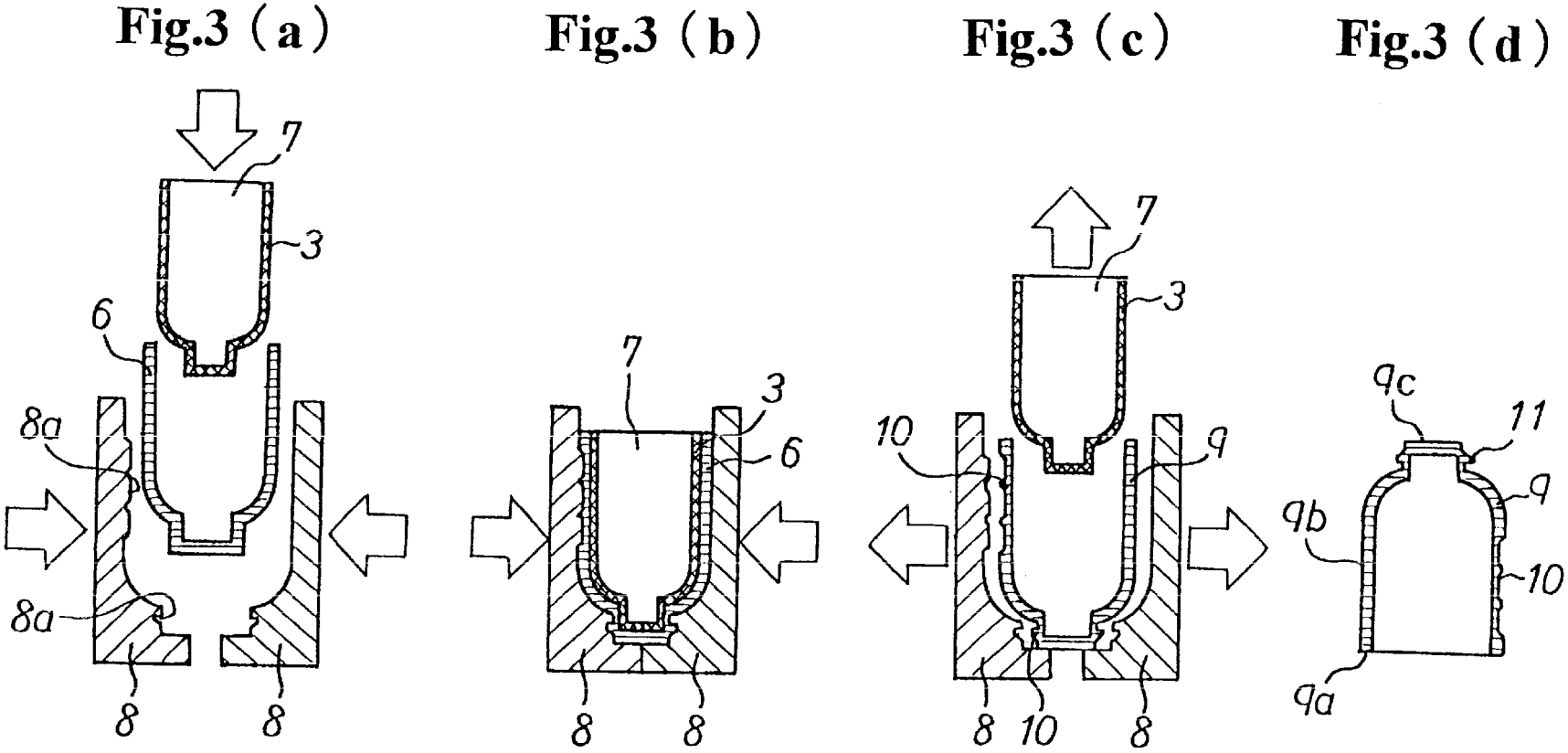
FIG. 3 is a flow chart showing a sequence of steps up to removal of a product from a mold, wherein FIG. 3(*a*) is the step of mold closure, FIG. 3(*b*) is the step of pressing, heating, and drying, FIG. 3(*c*) is the step of removing a hot pressing core, and FIG. 3(*d*) is the step of taking out a pulp molded article.

FIG. 1 is an enlarged partial cross-sectional view showing the pulp fiber deposited on a net. FIG. 2 is a flow chart showing the successive steps up to removal of a pulp deposited body from a mold, wherein FIG. 2(*a*) is the step of attaching a net, FIG. 2(*b*) is the step of papermaking, and FIG. 2(*c*) is the step of removing a pulp deposited body from a mold. FIG. 3 is a flow chart showing a sequence of steps up to removal of a product from a mold, wherein FIG. 3(*a*) is the step of mold closure, FIG. 3(*b*) is the step of pressing, heating, and drying, FIG. 3(*c*) is the step of removing a hot pressing core, and FIG. 3(*d*) is the step of taking out a pulp molded article.

In the first embodiment, a net layer 3 is composed of a first mesh 3*a* and a second mesh 3*b* which is finer than the first mesh 3*a* as illustrated in FIG. 1. The first mesh 3*a* is tightly put on a papermaking core mold 2, and the second mesh 3*b* is put on the first mesh 3*a*. With the fine mesh 3*b* on the coarse mesh 3*a*, the number of interconnecting holes 1 to be bored in the papermaking core mold 2 can be decreased, and pulp fiber can be accumulated to a uniform thickness to obtain a pulp deposited body 6 (hereinafter described in detail).

The method of producing a pulp molded article according to this embodiment is characterized by comprising putting a net layer having a coarse mesh and a fine mesh on a papermaking core mold having a plurality of interconnecting paths connecting the outside and the inside, depositing pulp fiber on the net layer to form a pulp deposited body, placing the pulp deposited body in a set of split molds for shaping (hereinafter sometimes referred to simply as split molds), drawing the papermaking core mold, and pressing the pulp deposited body for dehydration by a prescribed means. The net layer which is cylindrical is easy to put on the papermaking core mold.

The method of producing the pulp molded article according to this embodiment is explained below by referring to FIGS. 2 and 3. First of all, a net layer 3 having stretchability and softness is tightly put on the outer surface of a papermaking core mold 2 which is hollow and has a plurality of interconnecting holes 1 connecting the outside and the inside as illustrated in FIG. 2(*a*).

The present embodiment is to produce an almost cylindrical pulp molded article with the bottom opened, so that the papermaking core mold 2 is contoured to the outer shape of the pulp molded article. The papermaking core mold 2 is made of metal or plastics or a metallic or plastic net.

As shown in FIG. 2(*b*), the papermaking core mold 2 is put into a container 5 filled with a pulp slurry 4 and evacuated from the inside thereby to deposit pulp fiber on the net layer 3 under reduced pressure to form a pulp deposited body 6.

The pulp slurry is prepared by dispersing pulp fiber primarily in water. The pulp fiber is preferably wood pulp, such as soft wood pulp and hard wood pulp, or non-wood pulp, such as bamboo and straw. The pulp fiber preferably has a length of 0.1 to 10 mm and a thickness of 0.01 to 0.05 mm.

After the pulp deposited body 6 is dehydrated and dried, it is removed from the papermaking core mold 2 as shown in FIG. 2(*c*). The degree of drying is preferably such that the pulp deposited body 6 may have a water content of 1 to 70%. The closer to 1%, the better. Since the net layer 3 is formed of fine mesh material, the pulp deposited layer 6 can easily be removed from the papermaking core mold 2. The net layer 3 can easily be cleared of any remaining pulp fiber.

The pulp deposited body 6 thus removed is put on a hot pressing core 7 as shown in FIG. 3(*a*), and the hot pressing core 7 is held in by a set of vertically split molds 8 and 8. Preferably a net layer 3 having the same structure as described above is put on the hot pressing core 7, on which the pulp deposited body 6 is fitted.

The inner wall of at least one of the split molds 8 and 8 is given an uneven part 8*a* for forming a design or a screw configuration.

As shown in FIG. 3(*b*), the pulp deposited body 6 is pressed, dehydrated, and dried by the hot pressing core 7 and the set of split molds 8 and 8.

The pressing condition is preferably $9.8\times10^3$ Pa to $49.0\times10^5$ Pa. The heating condition is preferably 100° to 250° C., particularly 180° to 220° C. Drying efficiency is poor at temperatures lower than 100° C., and the pulp deposited body 6 tends to be burnt at temperatures exceeding 250° C.

As illustrated in FIGS. 3(*c*) and 3(*d*), the set of split molds 8 and 8 are opened, the hot pressing core 7 is removed, and a pulp molded article 9, which is made of the pulp deposited body 6 and has been shaped in conformity to the net layer 3, is taken out.

As shown in FIG. 3(*d*), the pulp molded article 9 thus produced has an open portion 9*a* at the bottom, a cylindrical body 9*b*, and a cylindrical upper portion 9*c* whose diameter is smaller than that of the body 9*b*. There is no seams on the open portion 9*a* or the body 9*b*, and the open portion 9*a* and the body 9*b* are integral. The pulp molded article 9 has a design 10 on the body 9*b* and a screw thread 11 around the upper portion 9*c*.

Thus, the pulp molded article 9 prepared in the present embodiment has an attractive outer appearance, having no holes, no net layer, no seams, etc. on its outer surface.

According to the present embodiment, since dehydration and drying of the pulp deposited body 6 are carried out by pressing in a set of split molds 8 and 8, any design of complicated configuration can be materialized irrespective of a draft angle, etc. to provide a pulp molded article with no restrictions on product contours. Further, since split molds 8 and 8 are used in this embodiment, various shapes can be given to the inner wall of the split molds 8 and 8 to add various designs to the surface of the product. Furthermore, use of the split molds 8 and 8 enables variation of the pressing pressure to easily control the wall thickness of the product (basis weight and density) thereby to adjust the rigidity of the product appropriately.

In the present embodiment, the net layer, being stretchable and soft, can easily be set tightly on even a papermaking core mold having a complicated shape along the contour of the core and is capable of forming thereon a pulp layer of uniform thickness.

The above-described bottomless pulp molded article may be made into a container by attaching a bottom formed in a separate line.

In this embodiment one or both of the split molds 8 and 8 may have a built-in heater (not shown) or may have a plurality of vacuum ports (not shown) interconnecting the outside and the inside. Such a built-in heater or vacuum ports will increase drying efficiency in drying the pulp deposited body 6 thereby reducing the molding cycle time and eventually providing a pulp molded article at a lower cost.

Air vents (not shown) may be formed on the surface of the split molds 8 and 8, whereby steam generated on hot pressing can escape easily to increase drying efficiency and to shortening the molding cycle time. A molded article with a beautiful appearance free from traces of air vents can be obtained While in the present embodiment the hot pressing core 7 is inserted into the pulp deposited body 6 removed from the papermaking core mold 2 so that the pulp deposited body 6 may be sandwiched in between the core 7 and the set of split molds 8 and 8, the separated pulp deposited body may be fitted into the set of split molds and shaped under a pressing force of a fluid, e.g., a gas introduced into the inside of the pulp deposited body. Heated gas would improve drying efficiency. In this case, one or both of the split molds 8 and 8 may have a built-in heater (not shown) or may have a plurality of vacuum ports (not shown) interconnecting the outside and the inside to further improve the drying efficiency.

The dehydration and drying by pressing with a fluid, for example, a heated gas, can be carried out via a hollow pressing member inserted in the inside of the pulp deposited body. This could be achieved by the method depicted in FIGS. 4(*a*) through 4(*c*), by which the shape of the open edge of the molded article can be controlled to have improved sealing properties in conjunction with a cap, etc.

Figure 4:
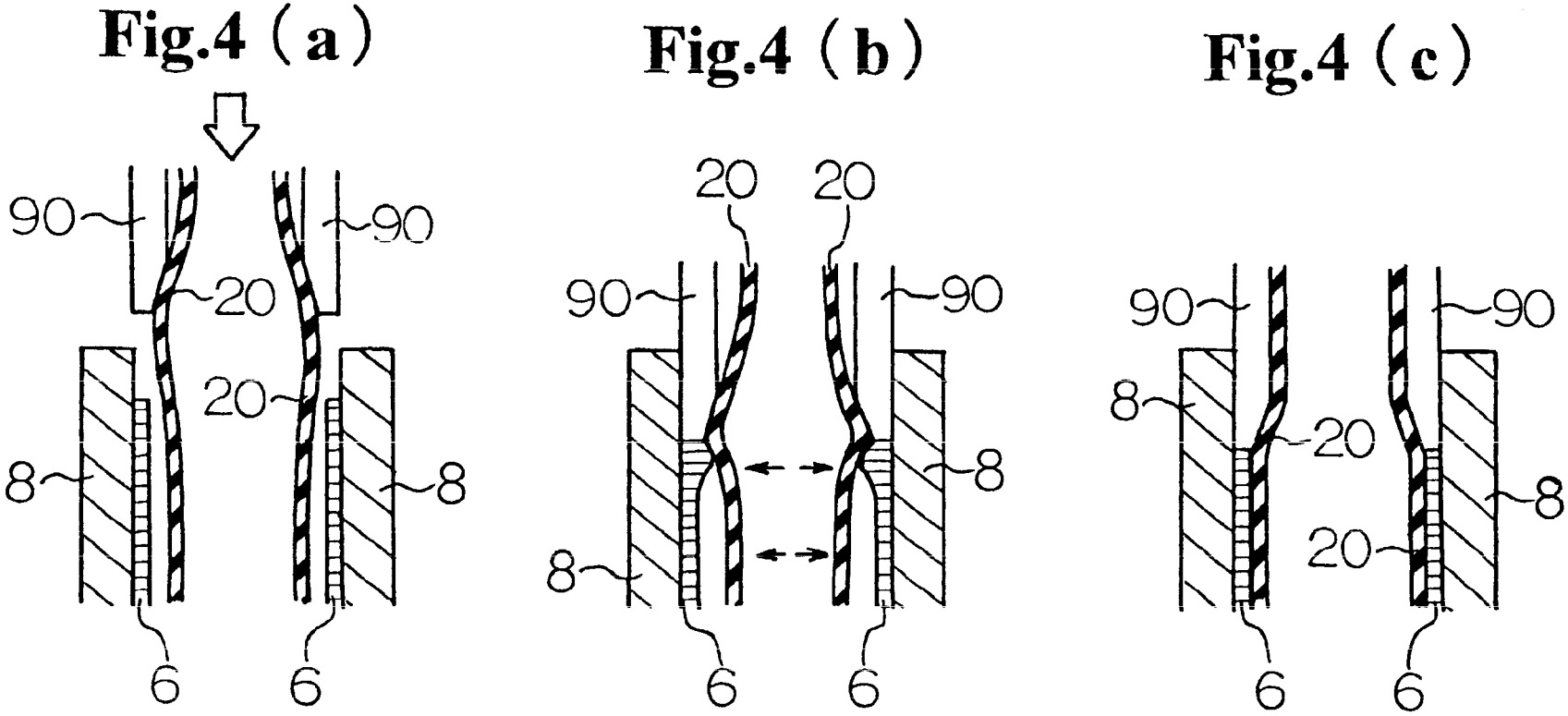
FIG. 4(*a*), FIG. 4(*b*) and FIG. 4(*c*) are a flow chart showing a sequence of steps for controlling the shape of the open edge of a pulp deposited body.

As shown in FIG. 4(*a*), the pulp deposited body 6 removed from the papermaking core mold 2 is placed in the set of split molds 8 and 8, and an edge finishing member 90, which is a metal-made cylinder, etc., is brought down from above the opening 6*a* of the pulp deposited body 6. A part of a pressing member 20 is fixed to the inner wall near the lower end of the edge finishing member 90. In this state the upper end of the open portion 6*a* is pressed down by the edge finishing member 90, and, at the same time, the pressing member 20 is inserted inside the pulp deposited body 6. As a result, the upper edge and its vicinity is protruded to have an increased thickness as shown in FIG. 4(*b*). As shown in FIG. 4(*c*), a fluid is then fed into the pressing member 20 to press the pulp deposited body 6 via the pressing member 20 onto the inner wall of the split molds 8 and 8 to shape the deposited pulp body 6 in conformity to a desired shape while dehydrating and drying the pulp deposited body 6. After dehydration and drying, the edge finishing member 90 is pulled up, and the pressing member 20 is taken out of the pulp deposited body 6. In this method, the pressing member 20 does not need to be fixed to the edge finishing member 90, in which case the pressing member 20 is inserted either before or after the edge finishing member 90 is pressed down. The pressing member 20 may be a bag that is not taken out after pressing and can serve as an inner layer of the pulp deposited body 6.

The hot pressing core 7 used in the above-mentioned embodiment may be replaced with a previously molded cold parison of a thermoplastic resin, which is heated, and the pressing is carried out by means of the above-described fluid via the heated parison. That is, the heated parison is inserted into the pulp deposited body, and a fluid, for example, a heated gas is fed into the heated parison to inflate it, by which the pulp deposited body is pressed, dehydrated, and dried.

The pulp deposited body 6 may be dehydrated under pressure by means of a cold pressing core in place of the hot pressing core 7 and then subjected to a separate step of heat-drying.

The second and third embodiments are then described. Only the particulars different from the first embodiment will be explained. To the same particular are appropriately applied the description about the first embodiment. The present embodiment is to give an example for manufacturing a carton, in which a papermaking core mold having a pulp deposited body formed on the outer surface thereof is put in split molds for shaping, and the papermaking core mold is inflated by a prescribed means to press the pulp deposited body toward the inner wall of the split mold cavity, whereby the inner shape of the cavity is transferred to the pulp deposited body, and the pulp deposited body is dehydrate and heat-dried while being pressed to give a pulp molded article.

Figure 5:
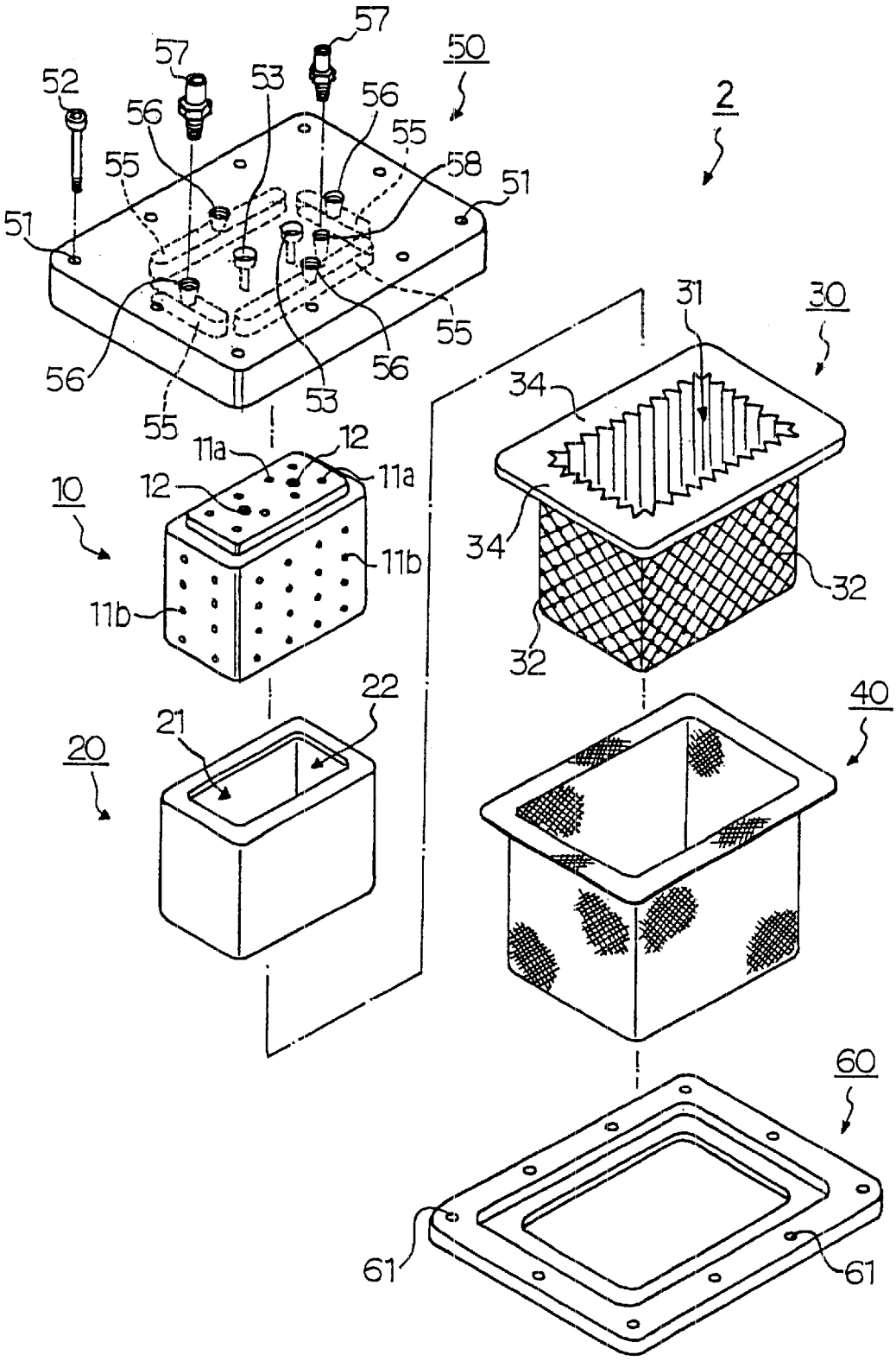
FIG. 5 is an exploded perspective view of a papermaking core mold used in the second embodiment of the present invention.
Figure 6:
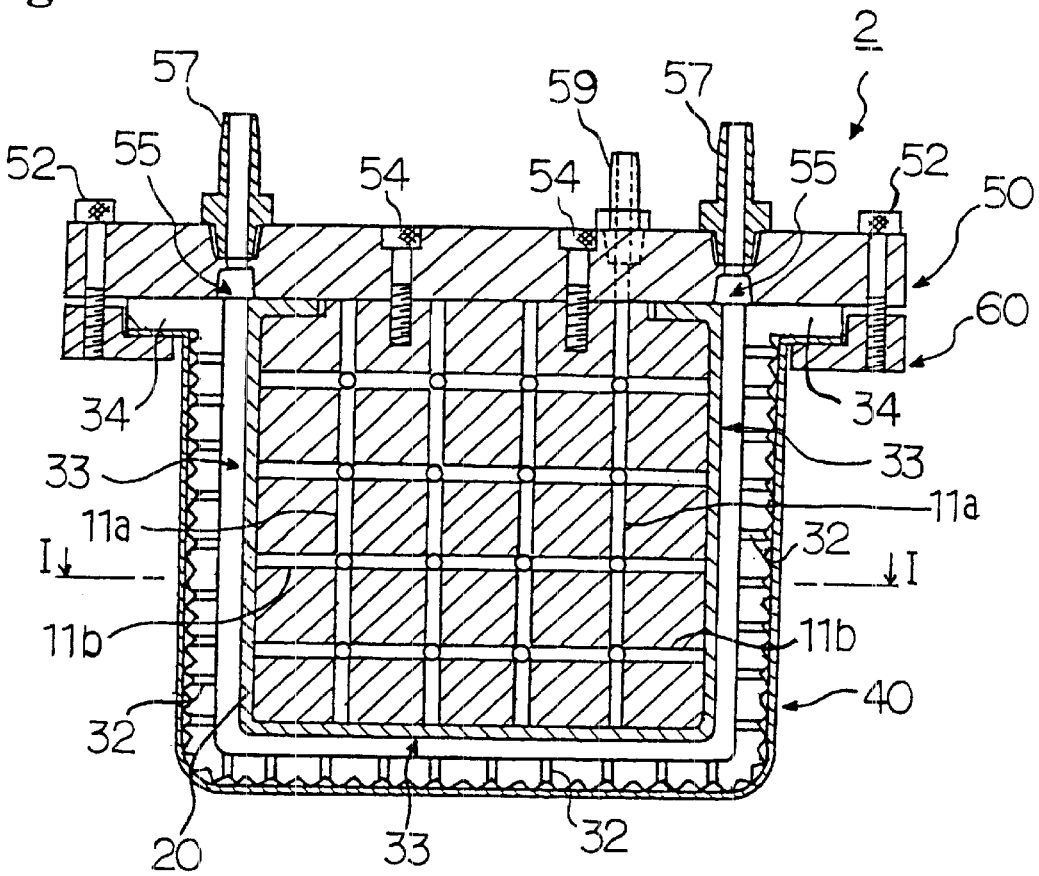
FIG. 6 is a longitudinal section of the papermaking core mold shown in FIG. 5.
Figure 7:
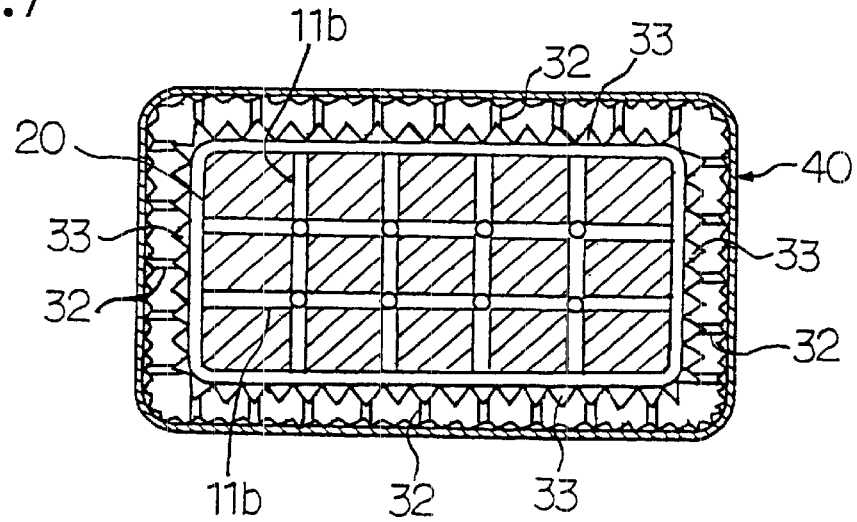
FIG. 7 is a transverse section of the papermaking core mold shown in FIG. 6, taken along line I—I.

In FIG. 5 is shown an exploded perspective view of a papermaking core mold (hereinafter simply referred to as a papermaking mold) 2 which is preferably used in the present embodiment. The papermaking mold 2 has a core of prescribed shape having a plurality of fluid feed channels interconnecting the inside and the outside, an inflatable pressing member in which the core is fitted, a core holding member having a cavity in which the core fitted in the pressing member is placed, and a stretchable net layer which tightly covers the outer surface of the core holding member. The core holding member has a plurality of through-holes interconnecting the exterior surface and the cavity. The core holding member is designed so that, when the pressing member containing the core is put in its cavity, there are formed spaces of prescribed shape between the inner wall of the cavity and the pressing member, the spaces being connected to the through-holes. The core holding member is made of a material deformable with the inflation of the pressing member. In more detail, the papermaking mold 2 has an almost rectangular parallelepiped core 10, a pressing member 20 in which the core 10 is fitted, a core holding member 30 for holding the core 10 fitted into the pressing member 20, a net layer 40 covering the outer surface of the core holding member 30, a clamping plate 50 for fixing the core 10, and a clamping frame 60. In FIG. 6 is shown a longitudinal section of the papermaking mold 2 assembled from these members, and in FIG. 7 is shown a transverse section taken along line I—I of FIG. 6.

The core 10 is a rigid body made of such a material as metal or plastics. The core 10 has a plurality of fluid feed channels interconnecting the inside and the outside. As shown in FIGS. 6 and 7, the fluid feed channels include a plurality of vertical fluid feed channels 11*a* which pierce the core 10 vertically and a plurality of transverse fluid feed channels 11*b* which pierce the core 10 transversely. The vertical fluid feed channels 11*a* are bored to make a number of parallel lines, and the transverse fluid feed channels 11*b* are bored similarly. Both the feed channels 11*a* and 11*b* are crossing each other to have intersections. Thus, a prescribed fluid introduced from the upper side of the core 10 through the vertical fluid feed channel 11*a* is fed to every side and the bottom of the core 10. The upper side of the core 10 has threaded holes 12, 12 for fixing the core 10 to the clamping plate 50.

As illustrated in FIG. 5, the pressing member 20 is a hollow member having an opening 22 at the top and a cavity 21 whose shape substantially agrees with the contour of the core 10. The core 10 is fitted into the cavity 21 from the opening 22. As illustrated in FIGS. 6 and 7, the pressing member 20 covers all the sides, the lower surface, and the upper periphery of the core 10, whereby the inside of the pressing member 20 is kept air-tight. In the assembled papermaking mold 2, the upper surface of the pressing member 20 and the upper surface of the core 10 are even as shown in FIG. 6. The pressing member 20 is made of a material that can be inflated with the fluid fed into the cavity of the pressing member 20 through the fluid feed channels 11*a* and 11*b* of the core 10. Such a material preferably is includes urethane, fluororubber, silicone rubber, elastomers, etc. which are excellent in tensile strength, impact resilience, stretchability, and the like.

The core holding member 30 is an almost rectangular parallelepiped hollow member with an open top, which has a cavity 31 in which the core 10 fitted into the pressing member 20 is to be contained. The core 10 fitted into the pressing member 20 is put into the cavity 31 from the upper side of the core holding member 30. The upper edge of the core holding member 30 is surrounded by a flange 34 which horizontally extends outward from the upper edge as shown in FIGS. 5 and 6. The flange 34 is held between the clamping plate 50 and the clamping frame 60. The depth of the cavity 31 is such that the upper surface of the flange 34 may be even with the upper surface of the pressing member 20 and the upper surface of the core 10 contained in the cavity 31 as shown in FIG. 6. Each of the sides and the bottom of the exterior surface of the core holding member 30 have an uneven pattern of meshes as shown in FIGS. 5 to 7.

As illustrated in FIGS. 5 through 7, the interior wall of the cavity 31 is serrated, having a large number of V-shaped grooves over the total height. While not shown, the bottom of the cavity 31 is also serrated, having a large number of V-shaped grooves. As shown in FIGS. 5 to 7, the core holding member 30 has a plurality of through-holes 32 connecting the cavity 31 to the outer sides and the outer bottom side. Each through-hole 32 is piercing between an intersection of the uneven mesh pattern on the exterior surface of the core holding member 30 and the valley of the V-shaped groove on the interior surface of the cavity 31. As a result, as shown in FIGS. 6 and 7, when the core 10 fitted into the pressing member 20 is contained in the cavity 31, there are formed a great number of spaces 33 of V-shaped grooves between the interior surface of the cavity 31 and the exterior surface of the pressing member 20, and interconnecting paths are formed to connect the spaces 33 to the through-holes 32. It is preferred for the through-holes to have a diameter usually of about 0.2 to 6 mm, preferably of about 1 to 4 mm, for facilitating uniform suction and for ease of boring. The density of the through-holes 32 is preferably 1 to 10, particularly 1 to 3, per $cm^2$ of the exterior surface of the core holding member.

The core holding member 30 is made of a material deformable with the inflation of the pressing member 20. Such a material includes flexible rubber, urethane rubber, and silicone rubber.

The net layer 40 is designed to cover the exterior sides and the exterior bottom side of the core holding member 30 tightly in conformity to the exterior surface profile as shown in FIGS. 6 and 7. Since the exterior surface of the core holding member 30 has an uneven mesh pattern, the net layer 40 tightly covering the exterior surface leaves prescribed spaces between the net layer 40 and the exterior surface of the core holding member 30 as shown in FIGS. 6 and 7. The net layer 40. is made of a stretchable material. Such a material includes natural materials, such as plant fibers and animal fibers, regenerated resins, semisynthetic resins, synthetic resins, e.g., thermoplastic resins and thermosetting resins, and metals. The net layer 40 may have either a single layer structure or a multilayer structure. Where the net layer 40 is a single layer, it is preferable for water absorption, air permeability and strength that the net layer 40 tightly covering the exterior of the core holding member 30 has an average open area ratio of 10 to 80%, particularly 20 to 40%.

Where the net layer 40 has a multilayer structure, it is preferred that the net layer 40 be composed of a first mesh that is coarse and a second mesh that is finer than the first mesh, which are used in the first embodiment. In this case, the first mesh, when tightly applied to the exterior of the core holding member 30, preferably has an average open area ratio of 10 to 99%, particularly 40 to 60%, and the second mesh preferably has an average open area ratio of 10 to 80%, particularly 20 to 40%.

The clamping plate 50 is rectangular and larger than the outline of the flange 34 of the core holding member 30 in its plan view. The clamping frame 60 has the same outline as the clamping plate in its plan view. A large number of through-holes 51 are made in the peripheral portion of the clamping plate 50. The clamping frame 60 also has a large number of through-holes 61 in the mating positions. The through-holes 61 have internal screw threads. In the assembled papermaking mold 1, a screw 52 is put in through the through-hole 51 of the clamping plate 50 and screwed in the through-hole 61 of the clamping frame 60 to clamp the flange 34 of the core holding member 30 between the clamping plate 50 and the clamping frame 60.

Through-holes 53 and 53 are pierced at the positions near the center of the clamping plate 50. These through-holes correspond to the threaded holes 12 and 12 of the core 10. In the assembled papermaking mold 2, a screw 54 is put in through the through-hole 53 and screwed in the threaded hole 12 of the core 10 to fix the core 10 to the clamping plate 50 as shown in FIG. 6.

As shown in FIGS. 5 and 6, four grooves are made on the lower side of the clamping plate 50 to form manifolds 55. In the assembled papermaking mold 2, each manifold 55 mates with the spaces 33 (see FIGS. 5 and 6) of V-shaped grooves which are formed by the core 10 fitted into the pressing member 20 being contained in the cavity 31. Each manifold 55 has a through-hole 56 in approximately the middle thereof, the through-hole 56 vertically piercing through the clamping plate 50. As shown in FIGS. 5 and 6, a connecting screw 57 having a vertical through-hole is screwed in each through-hole 56. When the papermaking mold 2 is used, the connecting screw 57 is connected to a prescribed suction means (not shown).

In the area of the clamping plate 50 surrounded by the four manifolds 55, another through-hole 58 is bored. As shown in FIG. 6, the position of the through-hole 58 corresponds to any one of the vertical fluid feed channels 11*a* formed in the core 10 when the members are assembled into the papermaking mold 2. As shown in FIG. 6, a connecting screw 59 having a vertical through-hole is screwed into the through-hole 58. When the papermaking mold 2 is used, the connecting screw 59 is connected to a prescribed fluid source (not shown).

When the papermaking mold 2 having the above-mentioned structure is set up, each of the connecting screws 57, each of the manifolds 55, the spaces 33 of V-shaped grooves, and the through-holes 32 are interconnected with each other in the order described to form interconnecting paths in the papermaking mold 2 through which the outside and the inside are connected. The exterior shape of the thus assembled papermaking mold 2 is slightly smaller than that of an article to be molded.

The method for producing a pulp molded article by use of the above-described papermaking mold 2 in accordance with the present embodiment is explained below. The steps involved in the method of producing the pulp molded article according to the present embodiment are illustrated in sequence in FIG. 8, wherein FIGS. 8(*a*) through 8(*f*) show the step of papermaking, the step of pulling up the papermaking mold, the step of pressing, shaping, and drying, the step of removing the papermaking mold, the step of opening the shaping split molds, and the step of removing a molded article from the mold, respectively.

Figure 8:
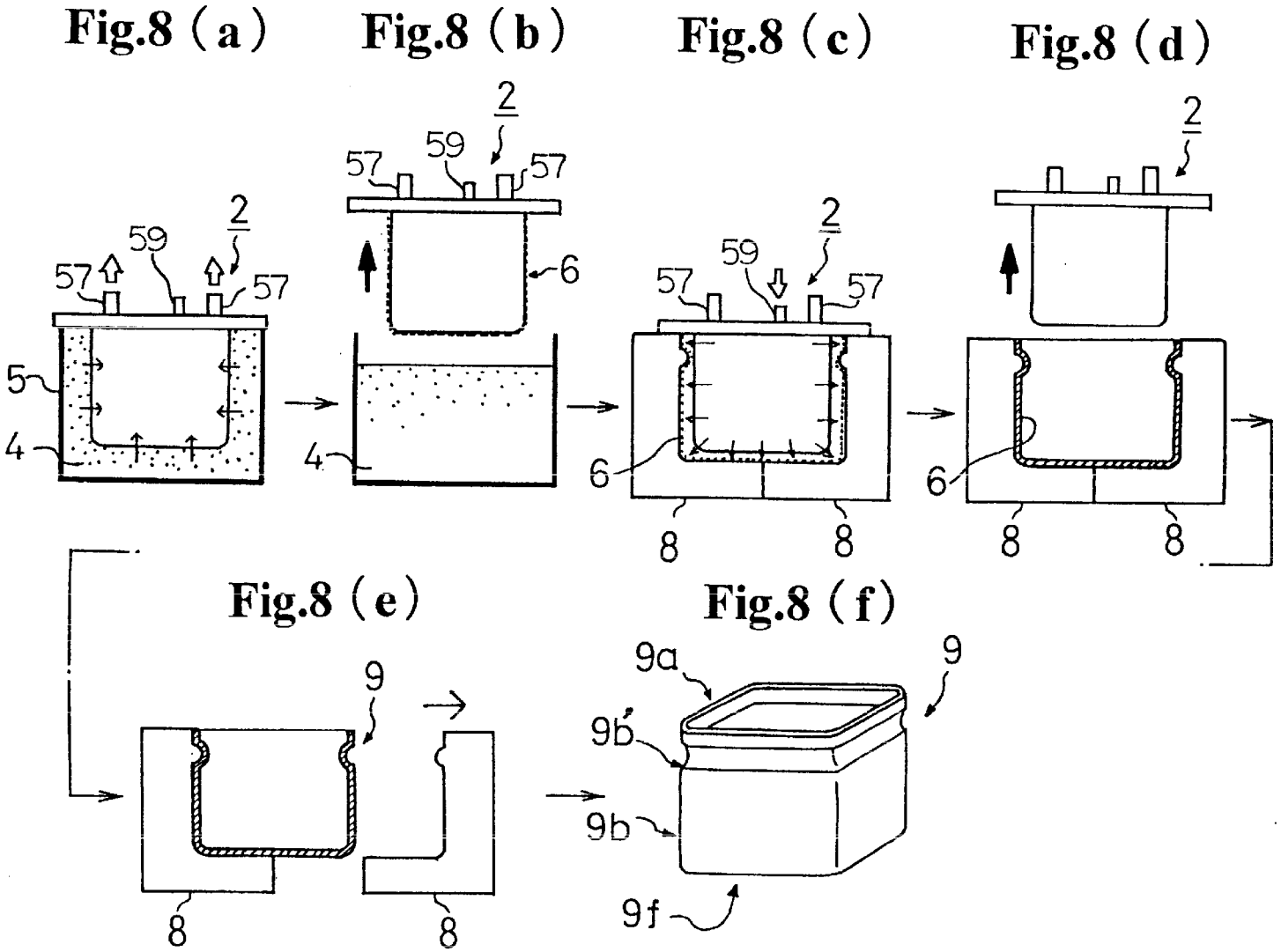
FIG. 8(*a*), FIG. 8(*b*), FIG. 8(*c*), FIG. 8(*d*), FIG. 8(*e*), and FIG. 8(*f*) are a flow chart showing a sequence of steps in the method for producing a pulp molded article according to the present invention.

To start with, the papermaking mold 2 is put in a container 5 filled with a pulp slurry 4 as shown in FIG. 8(*a*). The papermaking mold 2 is evacuated by a suction means such as a pump (not shown) connected to the connecting screw 57 through the above-described interconnecting paths. That is, water of the pulp slurry 4 is sucked in through the interconnecting paths, whereby pulp fiber is deposited on the surface of the papermaking mold 2, i.e., the surface of the net layer 40 to form a pulp deposited body 6. As stated above, since there are prescribed spaces between the outer side of the core holding member 30 and the net layer 40, pulp fiber are accumulated smoothly to form a pulp deposited body 6 having a uniform wall thickness. Where the net layer 40 has a double layer structure composed of the first mesh and the second mesh as described above, the formed pulp deposited body 6 becomes more uniform because the pulp fibers are prevented more effectively from getting entangled in the net layer 40 and making suction uneven in places. It is desirable for the core holding member 30 not only to be made of a deformable material with the inflation of the pressing member 20 as stated previously but to have such rigidity so as not to be deformed by the suction.

After a pulp deposited body 6 is formed to a predetermined thickness, as shown in FIG. 8(*b*), the papermaking mold 2 is pulled up from the pulp slurry 4, and the suction is stopped. The papermaking mold 2 having formed thereon the pulp deposited body 6 is then pressed, shaped and dried by use of split molds. In detail, as shown in FIG. 8(*c*) the papermaking mold 2 having thereon the pulp deposited body 6 is held from each side by a set of split molds 8 and 8 which, on being closed, provides a cavity corresponding to the contour of a desired molded article. Since the exterior shape of the papermaking mold 2 is slightly smaller than that of an article to be molded, the pulp deposited body 6 undergoes no deformation when it is set in the closed split molds 8 and 8.

Then, a fluid is poured into the core 10 under pressure from a fluid source (not shown) connected to the connecting screw 59. Consequently, the fluid passes through the vertical and transverse fluid feed channels 11*a* and 11*b* penetrating the core 10 and fed from the plurality of holes on every side and the bottom of the core 10 to the inside of the pressing member 20, thereby inflating the pressing member 20. With the inflation of the pressing member 20, the core holding member 30 and the net layer 40 are expanded. Similarly, the pulp deposited body 6 formed on the surface of the net layer 40 is deformed to expand and pressed onto the inner wall of the mold cavity. As a result, the configuration of the inner wall of the cavity is transferred to the pulp deposited body 6. Since the pulp deposited body 6 is pressed from its whole inside toward the inner wall of the cavity in this way, the configuration of the inner wall of the cavity can be transferred to the pulp deposited body 6 with good precision and with no uneven pressing no matter how complicated the configuration may be. Moreover, the resulting molded article has an extremely smooth surface. The term "smooth" as used herein means that the surface profile of a molded article obtained, either interior or exterior, has a mean line average roughness (Ra) of 50 $\mu$m or smaller and a maximum peak-to-valley height (Ry) of 500 $\mu$m or smaller.

The fluid which is used to inflate the pressing member 20 includes, for example, compressed air (heated air), oil (heated oil), and other various liquids. The pressure for fluid feed is usually 0.01 to 5.0 MPa, particularly 0.1 to 3 MPa, for preference, while depending on the kind of the fluid.

While the pulp deposited body 6 being pressed onto the inner wall of the cavity, the split molds 8 and 8 are heated to a prescribed temperature to dry the pulp deposited body 6. During the drying, evaporated water vapor can be discharged from the connecting screws 57 through the above-described paths so that the outer surface of the resulting molded article 9 is effectively protected from contamination. As a result, the molded article 9 has a satisfactory surface finish. After the pulp deposited body 6 is completely dried, the fluid in the pressing member 20 is withdrawn, whereby the papermaking mold 2 including the pressing member 20, the core holding member 30 and the net layer 40 shrinks to the size before expansion by its own elastic force. On the other hand, the pulp deposited body 6, having been given shape retention properties by the above step of heat drying, does not shrink so that it separates from the surface of the shrunken net layer 40 and remains in close contact with the cavity wall. In this state, the papermaking mold 2 having shrunken to the size before expansion is taken out from the inside of the pulp deposited body 6 as shown in FIG. 8(*d*). Where the net layer 40 has the above-mentioned double layered structure composed of the first mesh and the second mesh, since the pulp fibers have been prevented effectively from getting entangled in the net layer 40, the above-mentioned separation is effected extremely smoothly.

Subsequently, the split molds 8 and 8 are opened as shown in FIG. 8(*e*), and the molded article 9 is taken out. The resulting molded article 9 is a hollow article comprising an upper open portion 9*a*, a body 9*b*, and a bottom portion 9*f* as illustrated in FIG. 8(*f*), which is used as a hollow container suitable for containing powder or granules. Every side wall of the body 9*b* of the molded article 9 forms approximately 90° with the bottom of the bottom portion 9*f*. The height of the molded article 9 is 50 mm or greater. The body 9*b* of the molded article 9 has a continuous recess 9*b*' around its whole periphery. The molded article 9 has neither a butt seam nor a thicker-wall part. According to this embodiment, molded articles of various shapes including the above-described molded article 9 can be obtained with ease.

Figure 9:
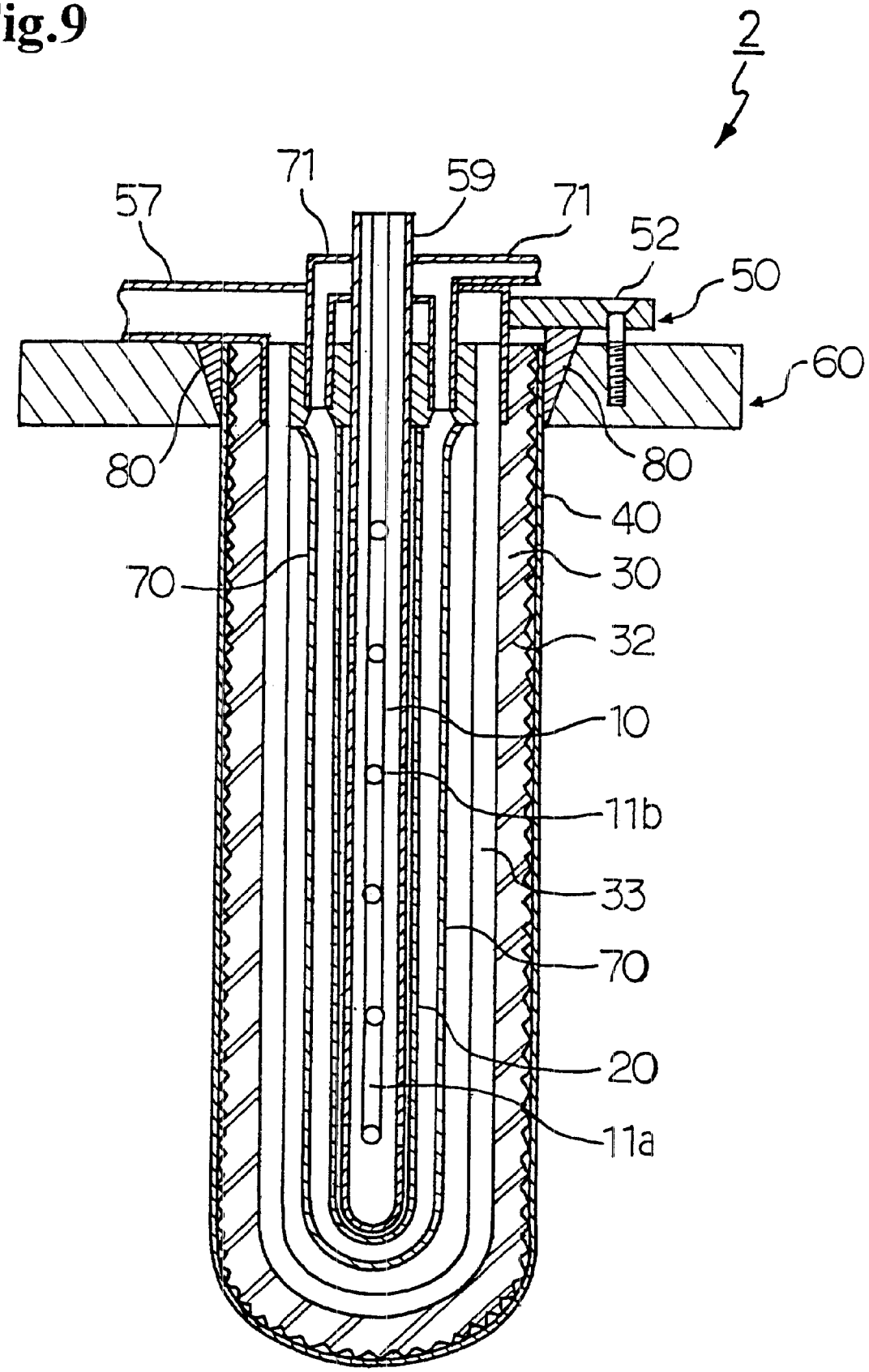
FIG. 9 is a longitudinal section of a papermaking core mold used in the third embodiment of the present invention (corresponding to FIG. 6).

FIG. 9 shows a longitudinal section of a papermaking mold 2 used in the third embodiment. The papermaking mold 2 is used for producing a tubular hollow molded article having an open top. Similarly to the papermaking mold used in the second embodiment, it has a core 10, a pressing member 20, a core holding member 30, a net layer 40, a clamping plate 50, and a clamping frame 60. Numeral 80 is a split annular wedge. The difference between the papermaking mold 2 used in this embodiment and that used in the second embodiment lies in that a second pressing member 70 is provided between the pressing member 20 and the core holding member 30. That is, the second pressing member 70 contains the pressing member 20 in which the core 10 is fitted, and the second pressing member 70 having fitted therein the pressing member 20 and the core 10 is placed in the core holding member 30. The second pressing member 70 is designed so that a fluid may be poured therein under pressure from a port 71 for liquid poring independently of the pressing member 20. Therefore, the second pressing member 70 is inflatable independently of the pressing member 20.. Since the papermaking mold 2 used in this embodiment has such a structure, when the pulp deposited body formed on the surface of the net layer 40 is pressed onto the inner wall of the split cavity, it is possible to inflate the pressing member 20 and the is second pressing member 70 separately. As a result, the degree of pressing can be controlled more delicately so that the configuration of the interior surface of the cavity can be transferred to the pulp deposited body more precisely. Further, when the papermaking mold 2 having been inflated and then let to shrink to the size before inflation can be removed from the inside of a pulp deposited body more satisfactorily.

The second pressing member 70 is made of a material that may be the same as or different from the material of the pressing member 20. The kind of the fluid that is poured into the second pressing member 70 under pressure may be either the same as or different from the fluid poured into the pressing member 20 under pressure.

The present invention is not limited to the above-described embodiments. For example, the edge finishing member 90 used in the first embodiment can be used in the second and third embodiments. Further, in each of the embodiments, the molded article 9 taken out of the split molds 8 and 8 may be subjected to post-processing, such as application of a plastic layer or a coating layer, etc. on the outer and/or inner surfaces thereof, for enhancement of the strength of the molded article 9 or for effective prevention of leakage, or a decorative finish may be given to the molded article 9.

While the set of split molds used in the above embodiments comprises two halves, three or more splits can be used as a set in accordance with the shape of a desired molded article.

The method of production according to the present invention is applicable to not only manufacturing of hollow containers in which things are to be put but other objects such as ornaments.

The steps involved in each embodiment and the members used therein are appropriately interchangeable with each other.

Industrial Applicability

The present invention provides containers of complicated shapes irrespective of a draft angle, etc. and a method for producing pulp molded articles having a beautiful appearance with excellent surface smoothness.

What is claimed is:

1. A method for producing a pulp molded article comprising the steps of:

depositing pulp fiber on the outer surface of a papermaking core mold having a plurality of interconnecting paths connecting the outside and the inside to form a pulp deposited body;

placing said pulp deposited body in a set of split molds;

pressing said pulp deposited body for dehydration by a prescribed means; and feeding a fluid into said pressing member to inflate said pressing member thereby pressing said pulp deposited body placed in said split molds, wherein said core mold is inflatable and comprises an inflatable hollow pressing member and a stretchable net layer, which is located at the outer surface of said core mold.

2. A method for producing a pulp molded article according to claim 1, wherein said papermaking core mold has a first mesh and a second mesh that is finer than said first mesh, and said pulp deposited body is formed on said second mesh.

3. An apparatus for producing a pulp molded article comprising:

means for papermaking; and means for heat-drying, wherein said means for papermaking comprises an inflatable papermaking core mold having a plurality of interconnecting paths connecting the outside and the inside, wherein said core mold comprises an inflatable hollow pressing member and a stretchable net layer, which is located at the outer surface of said core mold, and wherein said heat-drying means comprises a set of split molds capable of holding said core mold having thereon said pulp deposited body.

* * * * *